US012167760B2

(12) United States Patent
Zirbel

(10) Patent No.: US 12,167,760 B2
(45) Date of Patent: Dec. 17, 2024

(54) BODY CONTOUR CONCEALER DEVICE

(71) Applicant: Angela Zirbel, Marshfield, WI (US)

(72) Inventor: Angela Zirbel, Marshfield, WI (US)

( * ) Notice: Subject to any disclaimer, the term of this patent is extended or adjusted under 35 U.S.C. 154(b) by 103 days.

(21) Appl. No.: 18/094,818

(22) Filed: Jan. 9, 2023

(65) Prior Publication Data

US 2024/0225155 A1 Jul. 11, 2024

(51) Int. Cl.
*A41D 27/04* (2006.01)
*A41B 9/00* (2006.01)
*A41B 9/04* (2006.01)

(52) U.S. Cl.
CPC ..... *A41D 27/04* (2013.01); *A41B 9/004* (2013.01); *A41B 9/04* (2013.01)

(58) Field of Classification Search
CPC ..... A41D 27/04; A41B 9/004; A41B 9/04
See application file for complete search history.

(56) References Cited

U.S. PATENT DOCUMENTS 4,014,044 A * 3/1977 Figueroa ..... A41B 9/02 2/466
4,257,414 A * 3/1981 Gamm ..... A63B 71/12 602/72
4,967,768 A * 11/1990 Tatro ..... A63B 71/12 128/891
5,271,101 A * 12/1993 Speth ..... A41D 1/084 2/214
6,393,621 B1 * 5/2002 Redwine ..... A61F 13/49017 2/400
8,499,364 B2 * 8/2013 Dye ..... A41B 9/001 2/400
9,060,863 B2 * 6/2015 Zaltsberg ..... A61F 13/49017
9,854,850 B2 * 1/2018 Rana ..... A41B 9/004
10,575,995 B2 * 3/2020 Hörle ..... A61F 13/84
11,083,599 B1 * 8/2021 Churchill ..... A61F 2/50
2001/0001313 A1 * 5/2001 Widlund ..... A61F 13/4702 604/386
2004/0154079 A1 * 8/2004 Rana ..... A41B 9/04 2/406
2005/0039245 A1 * 2/2005 Landi ..... A41D 13/05 2/455
2005/0278839 A1 * 12/2005 Atwater ..... A63B 71/12 2/466
2008/0271229 A1 * 11/2008 Steszyn ..... A63B 71/1216 2/466
2010/0175170 A1 * 7/2010 Dye ..... A41B 9/004 604/367
2010/0175171 A1 * 7/2010 Dye ..... A41B 9/04 2/406

(Continued)

FOREIGN PATENT DOCUMENTS

WO WO 2015/163772 A2 10/2015

*Primary Examiner* — Khaled Annis
(74) *Attorney, Agent, or Firm* — Carlin Law LLC

(57) ABSTRACT

A device for the concealment of certain body contours in the groin region. The device is insertable within the gusset pocket of an undergarment and the device is made of generally flexible material such as PVC. The device additionally has curved edges on the top, the bottom, and both sides, as well as additionally containing numerous apertures which allow for airflow, as well as providing the device with the ability to twist bend and contort while a user is moving in their everyday activity.

3 Claims, 8 Drawing Sheets

(56) References Cited

U.S. PATENT DOCUMENTS

| | | | | |
|---|---|---|---|---|
| 2010/0275349 | A1* | 11/2010 | Wilson, II | A41D 13/0506 2/466 |
| 2011/0099693 | A1* | 5/2011 | Pratt | A41B 9/04 2/406 |
| 2012/0210496 | A1* | 8/2012 | Laurie | A41D 27/12 2/243.1 |
| 2012/0237758 | A1* | 9/2012 | Hook | B32B 27/283 428/317.3 |
| 2013/0291288 | A1* | 11/2013 | Dye | A41B 9/001 2/406 |
| 2013/0327340 | A1* | 12/2013 | Hardig | A41D 13/015 128/846 |
| 2016/0029703 | A1* | 2/2016 | Han | A41B 9/04 2/401 |
| 2016/0165959 | A1* | 6/2016 | Hayes | A41B 9/04 2/67 |
| 2020/0237021 | A1* | 7/2020 | Adams | A41B 9/04 |
| 2021/0007415 | A1* | 1/2021 | Sitt | A41D 27/12 |
| 2022/0183398 | A1* | 6/2022 | Ibrahim | A61F 13/47218 |
| 2023/0248078 | A1* | 8/2023 | Henderson | A41B 9/004 2/400 |

* cited by examiner

BODY CONTOUR CONCEALER DEVICE

FIELD

The present disclosure is directed to the field of Body Contour Concealer Devices, and more particularly to Devices for reducing the visual presence of certain body shapes and contours while a human user is wearing form-fitting clothing.

BACKGROUND

Fashion trends are constantly changing throughout the span of Western culture. As recently as the 1990s, baggy and loose clothing was desirable. However, recently, fashion trends have pivoted to tighter and more form-fitting clothing being favorable. With tighter clothing, the likelihood of exposing human contours increases.

The visual appearance of human contours, particularly for females, in areas such as the genitals is generally viewed non-desirable. When a person is wearing tight fitting clothing, an imprint of body contours may be visually present.

If said person was wearing yoga pants, or gym clothing, this may lead to embarrassment. Similarly, the presence of body contours on younger individuals while wearing leotards or swimsuits can lead to general awkwardness for everyone present.

Presently, some people will wear two pairs of undergarments which undesirably will increase the bulkiness in their genital region. However, this can lead to issues such as increased sweat, a lumpy external appearance, or increased uncomfortableness.

Attempts to create a thicker material on the groin area of clothing do not allow for athletic movements. Additionally, it is known that air flow promotes hygiene in the groin region, and thicker nonpermeable material will not be conducive to airflow.

What is needed, therefore, is a device which can decrease the visibility of body contours from the exterior of undergarments, swimsuits, leotards, or any other form-fitting or tight clothing, while additionally allowing for physical and an active lifestyle.

BRIEF SUMMARY

The present invention is directed to a Body Contour Concealer Device for the prevention of visible observation of certain body contours, particularly on the exterior of undergarments, leotards, swimming suits, or the like. The present invention is intended to be placed within the gusset of an undergarment, swimsuit, leotard, or the like.

Presently many undergarments, particularly women's undergarments, have a pocket-like portion, known as a gusset, located on the interior center portion of the undergarment. In a similar fashion, some swimsuits and leotards also have a gusset located within their interior. Generally, the gusset is made of cotton, or any other soft bendable material, regardless of what the rest of the undergarment is constructed from. The gusset is typically sewn with one end open, forming this aforementioned pocket shape. It is known by those with skill in the art that the gusset having an open side allows for better air flow so as to promote hygiene in a very sensitive area.

When the shape of the undergarment changes, the shape of the gusset may also change. For instance, typically undergarments have a rectangular-shaped gusset, wherein three of the four gusset sides are sewn to the undergarment and the fourth gusset side is open. In a thong, most gussets are triangular shaped and may have a very narrow gusset rear edge or may only have three sides, where two of the sides are sewn, with the front side being left open and unsewn.

As the shape of the gusset is modified, so too is the Body Contour Concealer Device, while still achieving all of the objects of the present invention despite the variance of exterior shape. With a triangular-shaped gusset, it is presently contemplated that a teardrop shaped Body Contour Concealer Device is preferable, as another shape may create a bulky look from a rear view, and additional portions of the Body Contour Concealer Device liner body bottom end may be visually exposed, which is not ideal. Such a teardrop-shaped liner body will have a top edge that is wider in width than the liner body bottom edge that has tapered side edges connecting the two edges, as is clear upon view of the drawings herein.

A rectangular gusset allows for a lemniscate-shaped Body Contour Concealer Device. In such a fashion, the liner body is tapered in the center but widened at both end portions, similar to a dumbbell, infinity sign, or an hourglass shape wherein the size of the top end is generally symmetrical with the size of the bottom end.

Regardless of the shape, the Body Contour Concealer Device preferably has multiple holes, known as apertures, within the liner body. The holes allow not only for air to travel therethrough, but also for the flexibility required within an active lifestyle.

In a preferred embodiment, the apertures are symmetrical in nature, such that they are mirror images of each other if the Body Contour Concealer Device were to be folded in half from the left side of the device to the right side of the device.

It is presently thought that the presence of curvilineal apertures allows for great flexibility as to the liner body of the Body Contour Concealer Device. These curvilineal apertures are generally similar to the curve of the exterior perimeter of the liner body. The curvilineal apertures thus allow for the human user to cross their legs without the fear of Body Contour Concealer Device shifting out of place or jabbing the user in a sensitive area.

The presence of additional angled apertures near the front end or the bottom end will allow for increased ability for the Body Contour Concealer Device to twist, contort, and fold in conjunction with the activities of a human user.

It is presently thought that numerous apertures will exponentially increase the flexibility of the Body Contour Concealer Device, and in some embodiments, this may be increasingly desirable.

To allow for great maneuverability, the liner body of the present device is generally malleable, which is a term defined herein to mean that the liner body material can twist, bend, and fold without breaking or snapping, and can revert back to its original shape thereafter. Thus, the liner body material is preferably flexible and composed of flexible material such as flexible polyvinyl chloride or PVC, leather, polymer, felt or any similar material.

These and various other features, advantages, modes, and objects of the present invention will be made apparent from the following detailed description and any appended drawings.

BRIEF DESCRIPTION OF THE SEVERAL VIEWS OF THE DRAWING

One or more preferred exemplary embodiments of the present disclosure are illustrated in the accompanying drawings in which like reference numerals represent like parts throughout and in which.

Before explaining one or more embodiments of the disclosed invention in detail, it is to be understood that this invention is not limited in its application to the details or modes of construction and the arrangement of the components set forth in the following description or previously disclosed illustrations. This invention is capable of multiple embodiments and modes, which can be practiced or carried out in many various ways. Also, it is to be understood that the phraseology and terminology employed herein is for the purpose of description, and should not be regarded as limiting, or used as an absolute.

DETAILED DESCRIPTION

Figure 1:
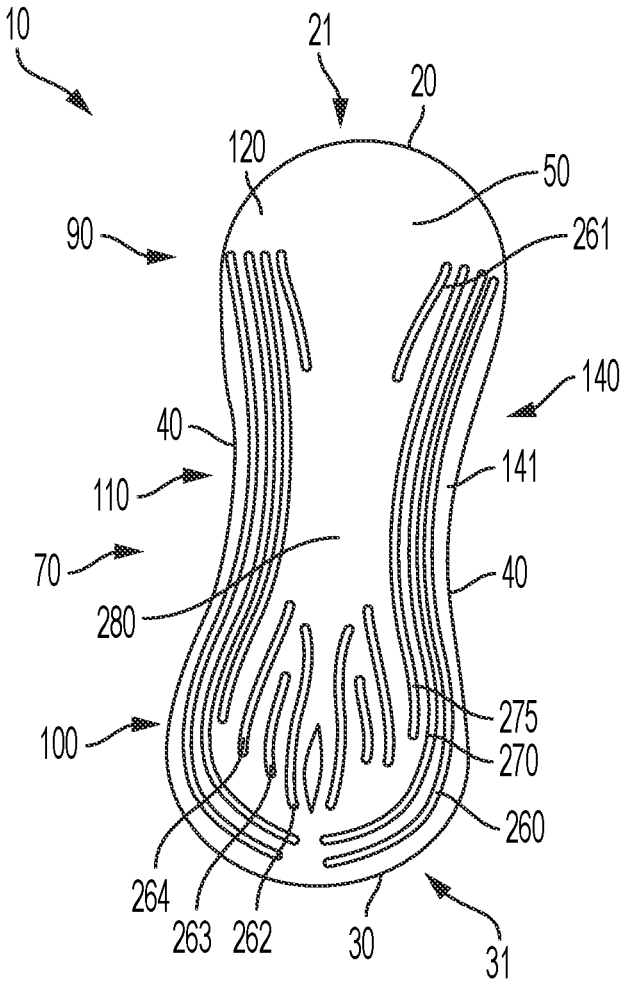
FIG. 1 is a perspective view of a preferred embodiment of the Body Contour Concealer Device with a lemniscate shape.

Referring now to the drawings in detail, FIG. 1 illustrates a preferred embodiment of a Body Contour Concealer Device 10 constructed in accordance with the present invention that is shown with a liner body 120 constructed in a lemniscate shape 70.

The liner body 120 is constructed of generally malleable material, such as soft leather, felt, polymer, or polyvinyl chloride, also known as PVC. The benefits of being malleable allow for the liner body 120 to bend, twist, and contort such that a human user preferably forgets that the Body Contour Concealer Device 10 is even present.

The lemniscate shape 70, as shown, has a front planar section 50 with a top edge 20, a bottom edge 30, and two side edges 40. There is a rounded top edge 21, to prevent inadvertent pokes or jabs in a human user. Similarly, there exists a rounded bottom edge 31, and the side edges 40 are generally concave tapered edges 110. The concave tapering edges 110 create the lemniscate shape, wherein the front end portion 90 and the rear end portion 100 are approximately symmetrical as to size.

As shown, a plurality of holes, known herein as apertures, exist upon the liner body 120. These apertures extend from the front planar section 50, or face, through the rear planar section 60, shown in FIG. 7. This creates a space therebetween, through the entirety of the liner body 120 itself, allowing air to pass therethrough.

Turning back to FIG. 1, two curvilineal apertures 260 are depicted, which are nonlinear bending apertures, that generally follow the shape of the perimeter 140 of the liner body 120 and are located near the interior perimeter of the liner body side edges 141. The curvilineal apertures 260 may be symmetrically disposed from each other, creating a mirrored image visual as from one side of the liner body 120 to the other. Thus, the location of the curvilineal apertures are approximately exactly opposing as from the central liner body portion 280, which is known as the central location of the liner body 120.

Additionally, a third curvilineal aperture 270 and a fourth curvilineal aperture 270 may be used in conjunction with the first two curvilineal apertures 260. The third and fourth curvilineal apertures 270 allow for greater flexibility of the liner body 120 when a human user is moving or performing any athletic or mobile function.

A fifth curvilineal aperture 275 and a sixth curvilineal aperture 275 may also be used, so as to provide even greater twisting and bending ability of the Body Contour Concealing Device 10.

It is presently contemplated that symmetry is advantageous, such that the curvilineal apertures, regardless of quantity, may be broken into two equal numbered apertures. These groups of apertures are then symmetrically disposed from one another, as from the central liner body portion 280. Such that when the liner body 120 is folded such that the two side edges 40 touch, the grouped curvilineal apertures would overlap.

To assist with the twisting motions that a human user may have during their daily activities, angled apertures 261 are placed near the top edge 20 of the liner body 120. These angled apertures 261 are positioned on the front end portion 90, and are symmetrically disposed from one another.

Figure 8:
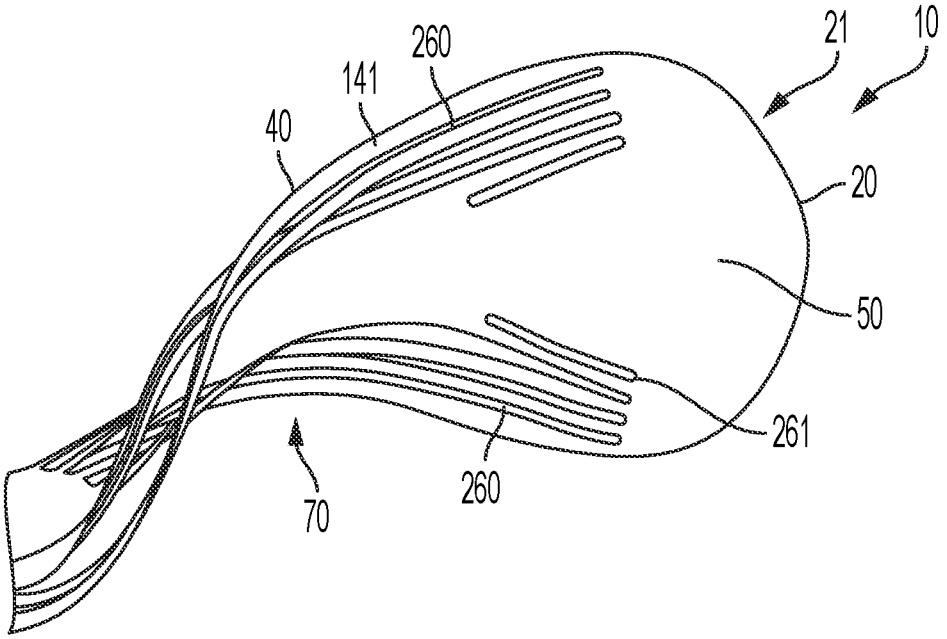
FIG. 8 is a perspective view of a lemniscate shaped embodiment of the Body Contour Concealer Device bent and twisted, highlighting the maneuverability of the device.

Near the bottom edge 30, on the rear end portion 100 are angled apertures 262. These angled apertures 262 allow for even more mobility of a human user, and one embodiment also discloses additional third and fourth angled apertures 263 located on the rear end portion 100, and further discloses a fifth and six angled aperture 264, which allows for the liner body 120 is able to twist and contort along with the human user, as depicted in FIG. 8. These angled apertures are shown as disposed into two equal numbered groups, said two groups symmetrically disposed from one another, as from the central liner body portion 280.

Figure 2:
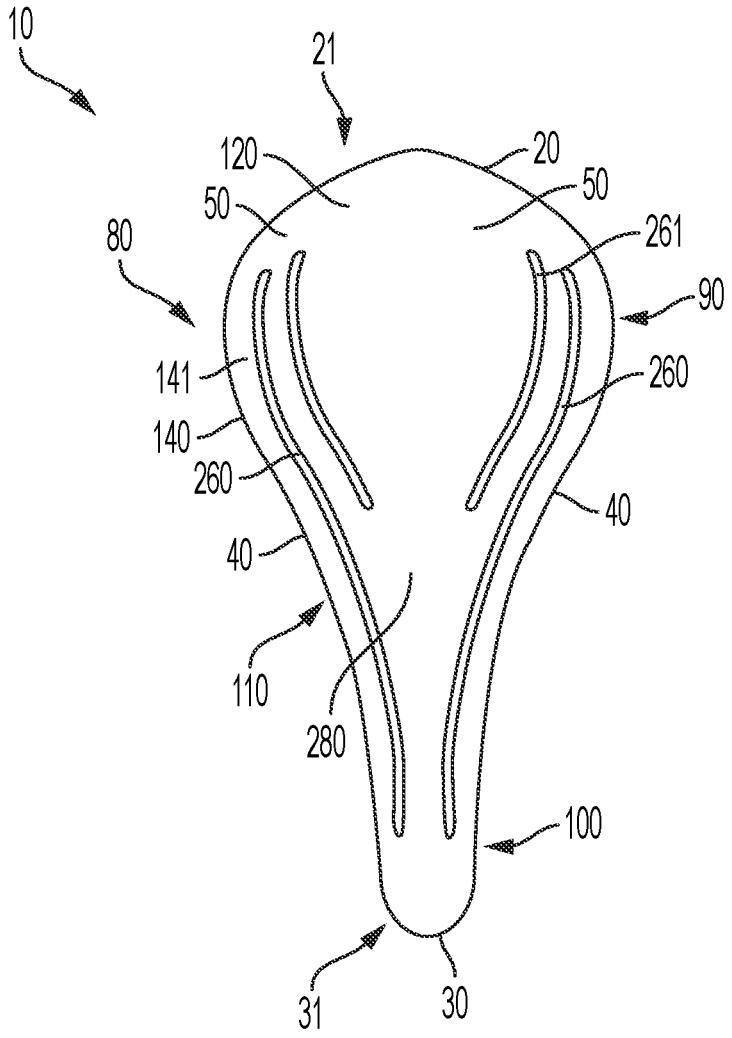
FIG. 2 is a perspective view of a preferred embodiment of the Body Contour Concealer Device depicting a teardrop shape.

Turning now to FIG. 2, the Body Contour Concealer Device 10 is shown with the liner body 120 in a teardrop shape 80. As discussed earlier, this shape may be advantageous for triangular shaped gusset undergarments, such as thongs or certain swimsuits.

In this embodiment of the Body Contour Concealer Device 10, the top edge 20 of the liner body 120 is a greater width than that of the bottom edge 30. Thus, the side edges 40 taper from the top edge 20 down to the bottom edge 30, which allows for the Body Contour Concealer Device 10 to be received within a triangular gusset, as depicted in FIGS. 5-6.

Figure 7:
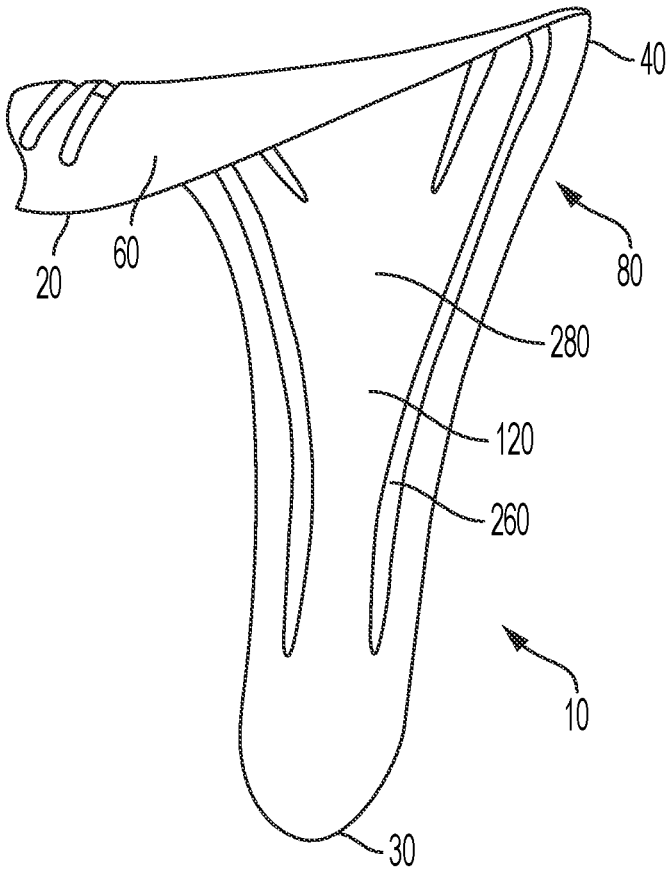
FIG. 7 is a perspective view of a teardrop shaped embodiment of the Body Contour Concealer Device in a cupped position.

There exist two curvilineal apertures 260, which are holes from the front planar face 50, also known as the rear planar section, through the rear planar face 60, also known as the rear planar section. These curvilineal apertures 260 mimic the general tapered down slope of the teardrop shaped perimeter 140, and allow for malleability and maneuverability, as shown in FIG. 7. Moving back to FIG. 2, two angled apertures 261 are shown, near the front end portion 90 of the liner body 120. These angled apertures 261 allow for the twisting movement anticipated by a human user.

Figure 3:
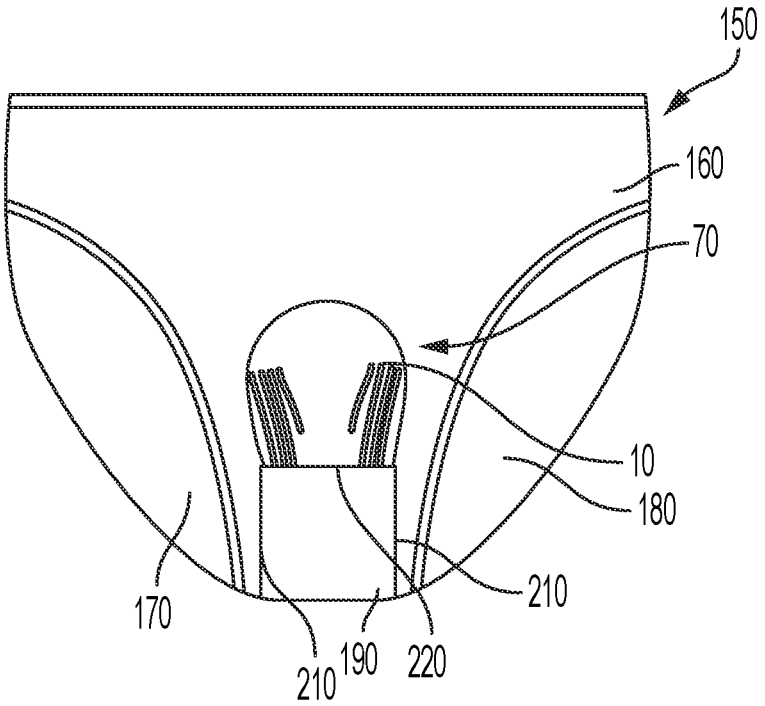
FIG. 3 is a perspective view of the interior of undergarments, with a gusset present and the Body Contour Concealer Device partially inserted therein.
Figure 4:
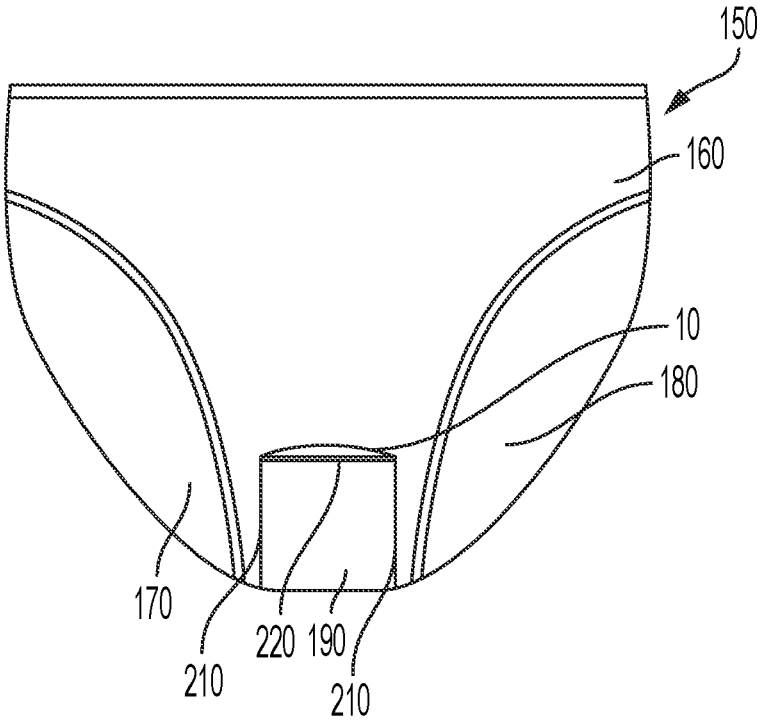
FIG. 4 is a perspective view of the interior of undergarments, with a gusset present and the Body Contour Concealer Device inserted completely therein.

FIG. 3 and FIG. 4 depict an undergarment turned inside-out. This undergarment 150 has a gusset 190 located on the undergarment body 160, said gusset 190 known as a pocket-like structure located between the left leg opening 170 and the right leg opening 180 of an undergarment. The gusset 190 has two side edges 210, which are sewn to the undergarment body 160, and a front edge 220 which is unsewn and open. This creates a pocket, which defines a volume within the gusset 190 itself. FIG. 3 highlights how the lemniscate shape 70 of the Body Contour Concealer Device 10 is able to be placed within the gusset 190 pocket, and FIG. 4 illustrates the view once the Body Contour Concealer Device is inserted into its final, operating position within said gusset 190.

Figure 5:
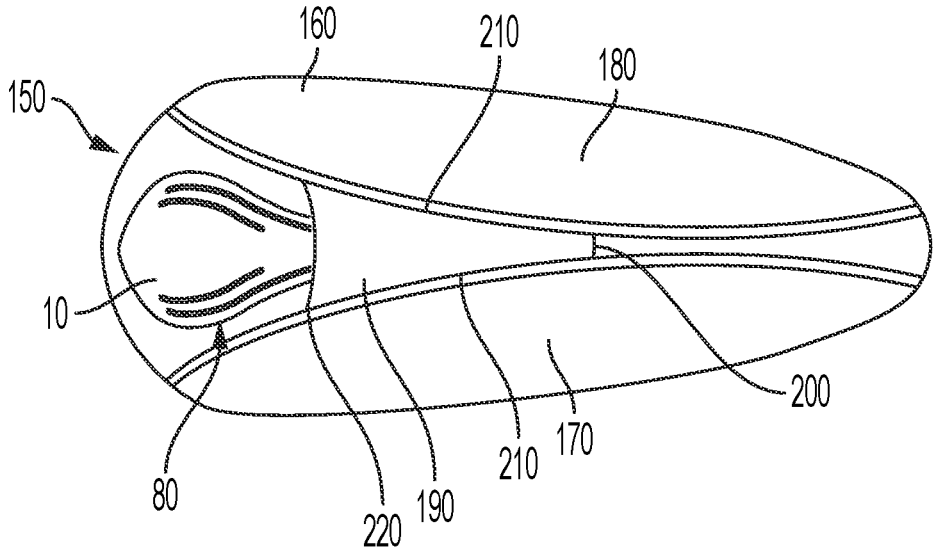
FIG. 5 is a perspective view of the interior of a thong undergarment, with a gusset present and the Body Contour Concealer Device partially inserted therein.
Figure 6:
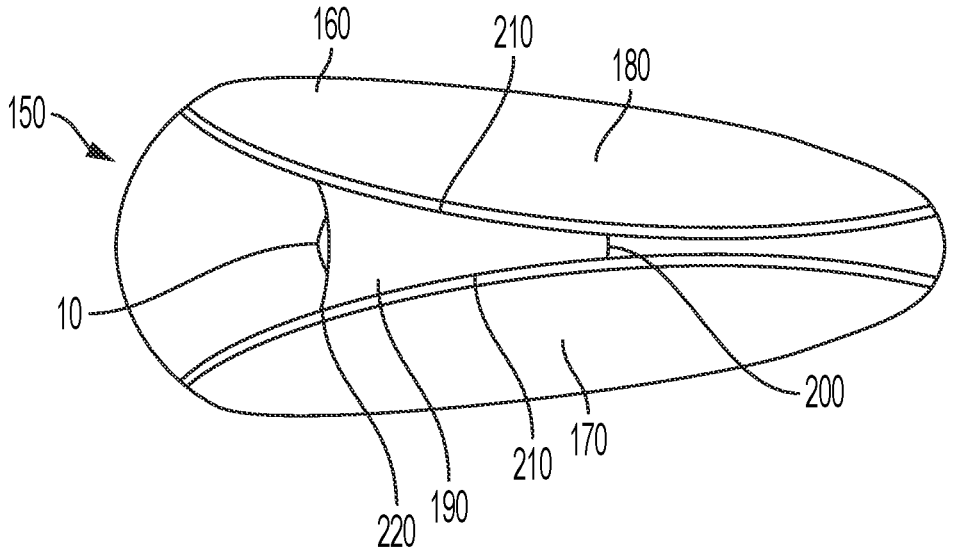
FIG. 6 is a perspective view of the interior of a thong undergarment, with a gusset present and the Body Contour Concealer Device inserted completely therein.

Looking now at FIG. 5 and FIG. 6, a different version of an undergarment is illustrated, turned inside-out. This undergarment 150 discloses a generally triangular shaped gusset 190, wherein the gusset rear edge 200 is substantially smaller width than that of the gusset front edge 220. Within the gusset 190, FIG. 5 illustrates how the teardrop shape 80 of the Body Contour Concealer Device 10 is utilized, with FIG. 6 showcasing the final operating position within the gusset 190.

Turning to FIG. 7, the teardrop-shaped 80 device is shown wherein the Body Contour Concealer Device 10 is bent, such that the rear planar section 60 folded towards bottom edge 30 of the liner body 120. This bending movement is possible due to the general malleability of the liner body 120.

FIG. 8 illustrates how the curvilineal apertures 260 and the angled apertures 261 allow for twisting and contorting of the Body Contour Concealer Device 10. This twist may be seen when a human user crosses their legs, or climbs a flight of stairs, or performs an athletic activity or movement. As is clear to those with skill in the art, the additional apertures allow for even greater twisting and contortion movements of the Body Contour Concealer Device 10.

Understandably, the present Body Contour Concealer Device 10 has been described above in terms of one or more preferred embodiments or models. It is recognized that various alternatives and modifications may be made to these embodiments and methods that are within the scope of the present invention. Various alternatives are contemplated as being within the scope of the present invention. It is also to be understood that, although the foregoing description and drawings describe and illustrate in detail one or more preferred embodiments of the Body Contour Concealer Device 10, to those skilled in the art of which this invention relates, the present disclosure will suggest many modifications, models, and constructions, as well as widely differing embodiments and applications without thereby departing from the spirit and scope of the invention.

What is claimed is:

1. A body contour concealer device adapted to be received with an undergarment gusset, said body contour concealer device comprising:

a generally teardrop-shaped liner body having a front planar face, a rear planar face, a top edge, a bottom edge, and two side edges;

two curvilineal apertures extending from the liner body front planar face beyond and through the liner body rear planar face, said curvilineal apertures extending a majority of an interior perimeter of the liner body side edges;

two angled apertures extending from the liner body front planar face beyond and through the liner body rear planar face, said two angled apertures located near the liner body top edge;

wherein said curvilineal apertures are symmetrically disposed from each other;

wherein said angled apertures are symmetrically disposed from each other;

wherein said liner body bottom edge is a width smaller than that of the liner body top edge;

wherein said liner body side edges taper from the liner body top edge down to the liner body bottom edge;

wherein said liner body top edge is rounded; and wherein said liner body bottom edge is rounded.

2. The body contour concealer device of claim 1, wherein the liner body is composed of flexible polyvinyl chloride.

3. The body contour concealer device of claim 1, wherein the liner body is composed of leather.

* * * * *